US009447666B2

(12) United States Patent
Morrow

(10) Patent No.: US 9,447,666 B2
(45) Date of Patent: Sep. 20, 2016

(54) ROD ATTACHED APPARATUS FOR CONNECTING A ROTATING DRIVE ROD STRING TO A DOWNHOLE ASSEMBLY

(71) Applicant: HARRIER TECHNOLOGIES, INC., Greenwich, CT (US)

(72) Inventor: William Bruce Morrow, Santa Barbara, CA (US)

(73) Assignee: HARRIER TECHNOLOGIES, INC., Greenwich, CT (US)

( * ) Notice: Subject to any disclaimer, the term of this patent is extended or adjusted under 35 U.S.C. 154(b) by 249 days.

(21) Appl. No.: 14/153,454

(22) Filed: Jan. 13, 2014

(65) Prior Publication Data

US 2014/0196882 A1 Jul. 17, 2014

Related U.S. Application Data

(60) Provisional application No. 61/752,157, filed on Jan. 14, 2013.

(51) Int. Cl.
*E21B 43/12* (2006.01)
*E21B 17/02* (2006.01)

(52) U.S. Cl.
CPC ..... *E21B 43/126* (2013.01); *E21B 17/02* (2013.01)

(58) Field of Classification Search
CPC .... E21B 43/12; E21B 43/126; E21B 43/129; E21B 17/02; F04D 13/10
See application file for complete search history.

(56) References Cited

U.S. PATENT DOCUMENTS

2011/0048738 A1* 3/2011 Morrow ..... E21B 43/126 166/380
2013/0105156 A1* 5/2013 Bara ..... F04D 13/10 166/272.3

* cited by examiner

*Primary Examiner* — Yong-Suk (Philip) Ro
(74) *Attorney, Agent, or Firm* — Ladas & Parry LLP

(57) ABSTRACT

A system for disengaging a power supply at the surface of a well from a downhole assembly having a pump for pumping fluid in the well to the surface thereof. A captured spline assembly interposed in the rod string, selectively connected to the downhole assembly to provide torsional drive.

4 Claims, 5 Drawing Sheets

ROD ATTACHED APPARATUS FOR CONNECTING A ROTATING DRIVE ROD STRING TO A DOWNHOLE ASSEMBLY

This application claims the benefits of earlier filed provisional application Ser. No. 61/752,157, filed on Jan. 14, 2013.

The present invention relates, in a general sense, to oil and gas production wells and, more particularly, to improved apparatus and methods for connecting, disconnecting and retrieving a downhole assembly including, e.g., geared centrifugal pumps.

BACKGROUND OF THE INVENTION

Field of the Invention

In a typical production well, a downhole assembly is lowered to a predetermined depth where it is immersed in the fluid deposit. The pump is driven by a power supply at the surface of the well and a rod string spans the distance between the power supply and the pump in order to drive the pump.

The geared centrifugal pump (GCP), among other devices, utilizes the rod string to rotationally drive a downhole pump. In the case of the GCP, this rod string is run inside the production tubing after the pump assembly has been run and set at the desired downhole location. The current method of connecting the rod string to the downhole assembly, so that rotational force can be transmitted to that assembly, is via a male stab-in rod attached to the end of the drive rod string that fits into a companion female receptacle in a receiver at the top of the downhole assembly.

This stab-in rod has a square, hex, spline or other cross section that fits snugly into a like-shaped female receptacle in the receiver. The stab-in rod is not attached to the receptacle for tensional loads and is of such length as to permit free movement vertically to adjust to differential vertical movement between the rod string and the downhole assembly. The stab-in rod, via the drive rods, rotates the female receptacle, which is fixedly attached to the drive shaft that extends through the upper seal section. In the case of the GCP, the drive shaft is attached to the input shaft of a speed increasing transmission, which, in turn, drives a centrifugal pump.

An important disadvantage to this system of a male stab-in shaft and a female receptacle is debris can collect in the female receptacle before the rod string is run, or when the rod string is removed for service, making it somewhere between difficult to impossible to re-engage the stab-in rod into the receiver.

The present invention addresses that problem by eliminating a female receiver that is open to the unwanted collection of clogging debris.

SUMMARY OF THE INVENTION

In the business of oil and gas production, time is literally money. It is readily understood, therefore, that any difficulty in connecting the rod string to the downhole assembly costs dearly.

With that understanding, it is clearly a great advantage of the present invention to the oil producer, to eliminate the prior art difficulties experienced when, as and if the female receptacle is in any way impaired, so as to greatly increase the difficulty with which the rod string is engaged with the downhole assembly.

It is a further benefit of the present invention to provide a mechanism, and a method of operation, which enhances the ability of the producer to connect the rod string with the downhole assembly.

Other objects and advantages of the present invention will become apparent to those skilled in the art from a reading of the following Detailed Description Of The Preferred Embodiment when read in concert with the drawings.

It will quickly become apparent that all of the drawings are pictorial representations of the area in the production tubing wherein the downhole assembly is engaged by the rod string, and disengaged as needed.

DETAILED DESCRIPTION OF A PREFERRED EMBODIMENT

The following detailed description discloses, to those skilled in the art, a novel system for engaging a downhole assembly with a rod drive string.

Figure 1:
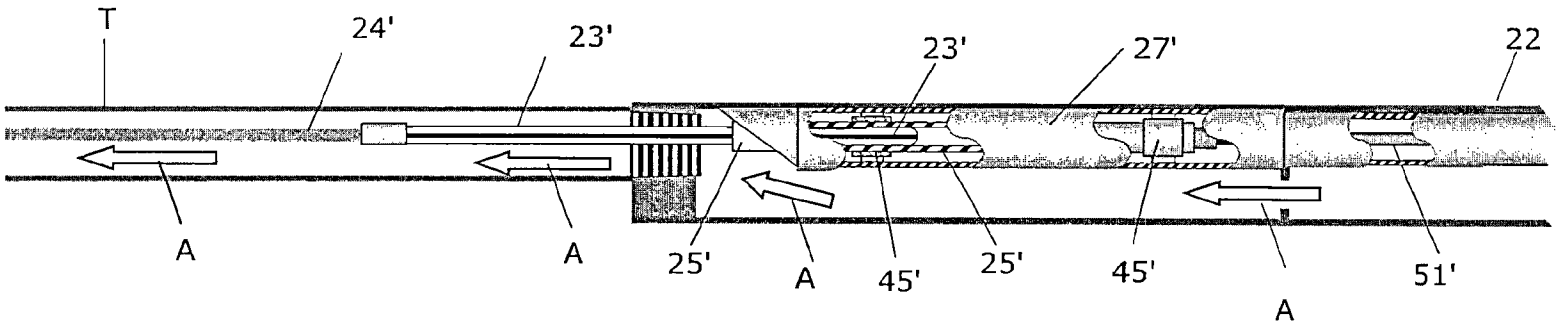
FIG. 1 (Prior art)
FIG. 1 is a depiction of the upper portion of a downhole assembly with a short section of connecting tubing, in the area of connection between a downhole assembly and a rod drive string, illustrating the mechanics of the connection in current use embodiment, wherein a female receptacle extends upwardly from the downhole assembly and is engaged by a depending drive rod and stab-in shaft.

It will be observed that in FIG. 1, which illustrates the current practice in the industry, various elements of a system to connect a downhole assembly 22 to a drive rod string are shown by numbers followed by a prime sign. Drive rod string 24' is attached to splined stab-in rod 23', which is inserted into the female spline receptacle in receiver 25'. The downhole assembly is thereby rotationally connected to the drive rod string 24'. Arrows A indicate the direction of fluid flow in the production tubing and downhole assembly.

Figure 2:
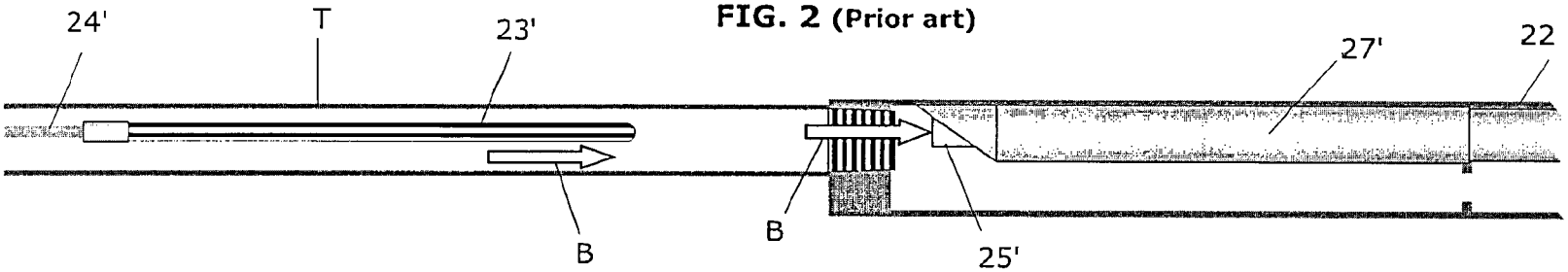
FIG. 2 (Prior art)
FIG. 2 illustrates, pictorially, the current use embodiment with the drive rod and stab-in shaft disengaged, leaving the female receptacle open for ingress of debris.

This connection method functions satisfactorily until the stab-in rod is removed from the splined female receiver, as shown in FIG. 2, when the upward facing female receiver 25' is open to the ingress of downward moving debris, shown by arrows B.

Figure 3:
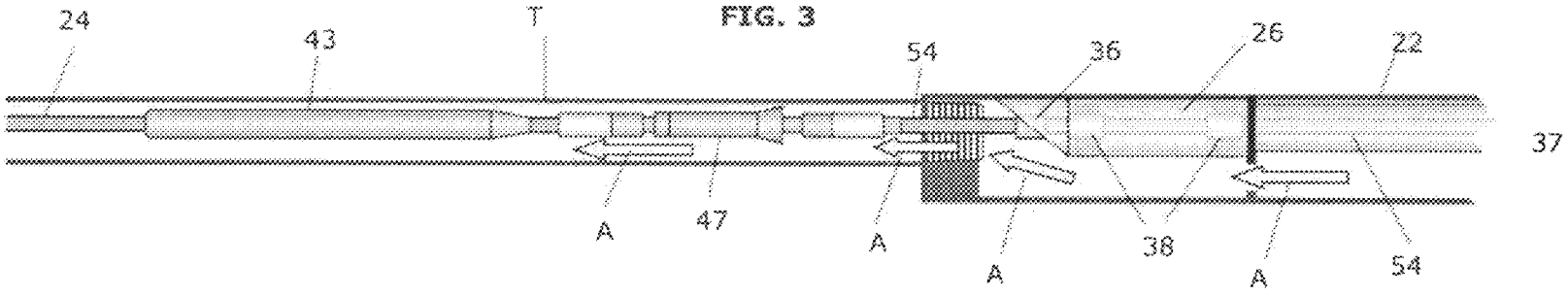
FIG. 3 is a view similar to that of FIG. 1, the difference being the FIG. 3 embodiment illustrates the structure which characterizes the present invention, wherein the connection between the downhole assembly and the drive rod string is via a captured spline assembly engaging an on-off tool, the female portion of which is attached to the end of the drive rod string and the male portion is attached to an upward extending male receiver shaft.
Figure 4:
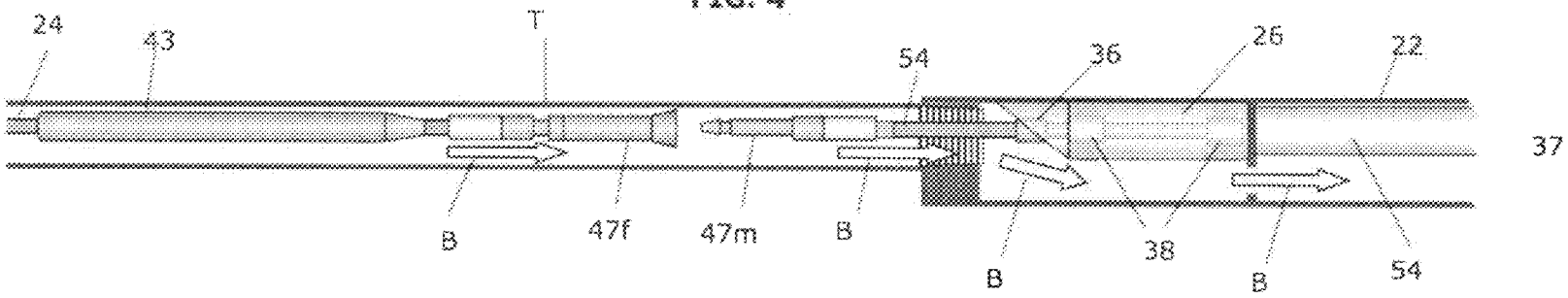
FIG. 4 illustrates, pictorially, the present invention with the drive rod string and captured spline assembly disengaged from the receiver shaft.

As shown in FIGS. 3 and 4, and in accordance with the present invention, the debris-clogging problem of the open female receiver 25' shown in FIG. 2 is eliminated by reversing the downhole rod/receiver elements of the connection and making the rod-end connector the female portion 47*f* of an on-off assembly 47, and the receiver connector the male portion 47*m* of the on-off assembly.

Accordingly, with this FIG. 3 configuration, and as shown in FIG. 4, when the drive rod string 24 is withdrawn from engagement with the receiver 26, by disconnecting the on-off tool 47, there is no open receptacle facing upwardly towards the surface into which the debris can collect, and the debris, shown as arrows B, falls harmlessly past the receiver 26 where it will settle into the flow channels of the downhole assembly 22 and does not interfere with the connection between the drive rod string 24 and the receiver 26.

There are principal advantages to the present invention when operationally attaching a rod string to a downhole assembly, and, they are:

1. The rods can be run after the downhole assembly is installed;
2. The rod string is able to move vertically, freely, while still in torque transmitting connection with the downhole assembly;
3. The rod string can be detached and retrieved without requiring the retrieval of the downhole assembly.

Referring to FIGS. 3 and 4, a system is configured to show the structure of the present invention in its simplest form. The system consists of a captured spline assembly 43 attached at its uphole end to the drive rod string 24. The captured spline assembly is attached to the receiver input drive shaft 54 by an on-off assembly 47, shown in FIG. 3 in its connected state. Drive shaft 54 extends through the receiver 26 and on into the downhole assembly 22. The captured spline assembly 43 provides a torsional connection between the drive rod string 24 and the input drive shaft 54 while also allowing relative vertical movement of the drive rod string 24 and the input drive shaft 54.

FIG. 4 shows on-off tool 47 in its disengaged state, where the drive rod string 24 and the input drive shaft 54 are neither tensionally nor torsionally connected. Note in FIG. 4 that the two parts of the on-off tool, the female portion 47*f* which is attached to the captured spline assembly 43, and the male portion 47*m* which is attached to the receiver input drive shaft 54, are disengaged.

In FIG. 3 the male portion 47*m* of the on-off tool 47 is inserted and locked into the female part 47*f*, thereby connecting both tensionally and torsionally the drive rod string 24 and captured spline assembly 43 to the receiver drive shaft 54. Drive shaft 54 extends into receiver 26 and is equipped with a shaft seal 36 to keep debris from entering the receiver, as well as shaft bearings 38 to align and support its rotation.

Figure 5A:
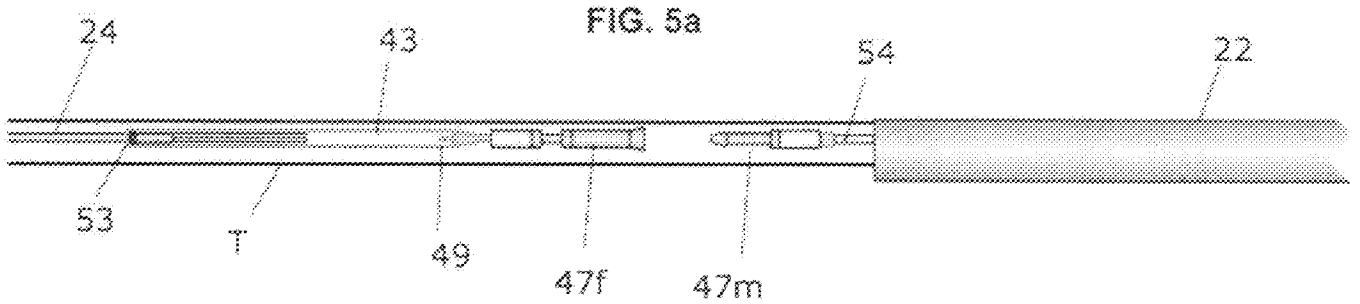
FIGS. 5*a, b* and *c* illustrate, pictorially, a sequence of downhole activity, when one employs the FIGS. 3 and 4 embodiment, in which the captured spline device attached to the drive string is initially moved into position to engage and capture, via the on-off tool, the receiver shaft extending upwardly from the downhole assembly.
Figure 5B:
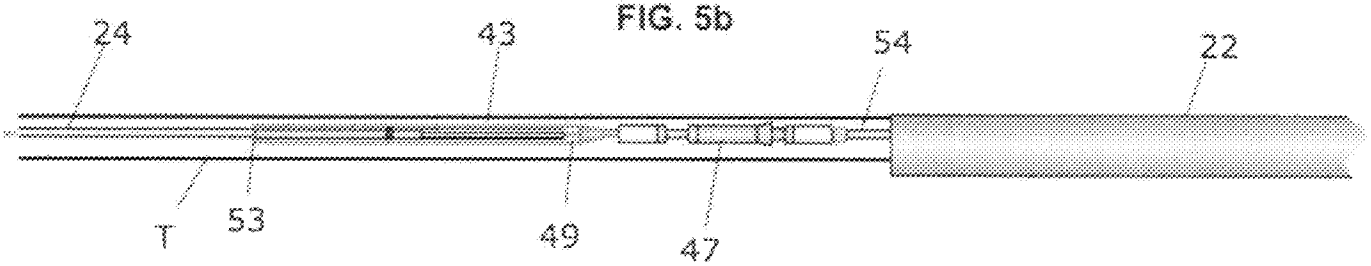
Figure 5C:
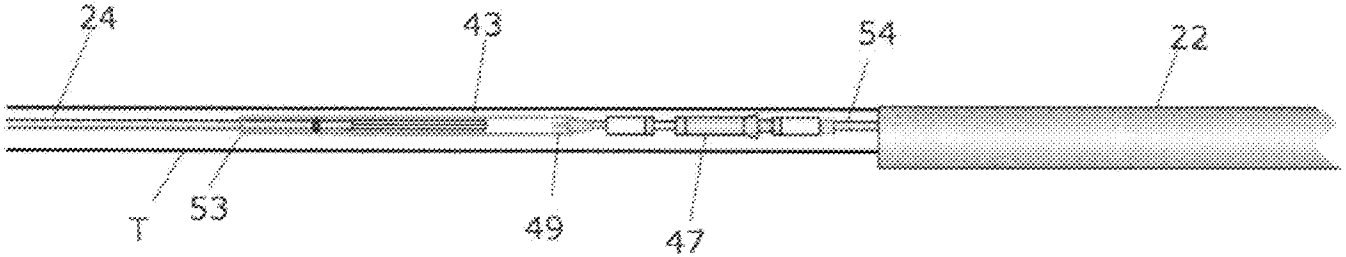

FIGS. 5*a, b*, and *c* show pictorially the process of engaging the receiver drive shaft 54 with the drive rod string 24 and captured spline assembly 43 described above. The bottom-hole assembly 22 is run in the hole on the production tubing T and set at the desired depth. The drive rod strings 24, with the captured spline assembly 43 and female portion of the on-off tool 47*f* are run near the expected depth of the connection with the male portion of the on-off tool 47*m* (FIG. 5*a*), and slowly eased down until the female half of the on-off tool 47*f* fully engages and locks with the male half 47*m*, and the captured spline assembly is in the fully collapsed state, with the spline shaft 45 resting against the cushioning spring 49 (FIG. 5*b*). The rods are then pulled up to full weight and then another approximately 1.5 feet, and hung off (FIG. 5*c*). This will give the rods about 1.5 feet of relative downward travel and 1.5 feet of relative upward travel without either tagging the cushioning spring 49, or hitting the upward travel stop 53 in the captured spline assembly. This amount of freedom of vertical travel should be sufficient to accommodate any expected relative vertical movement between the drive rod string 24 and the receiver drive shaft 54 during normal pumping operations.

Figure 6:
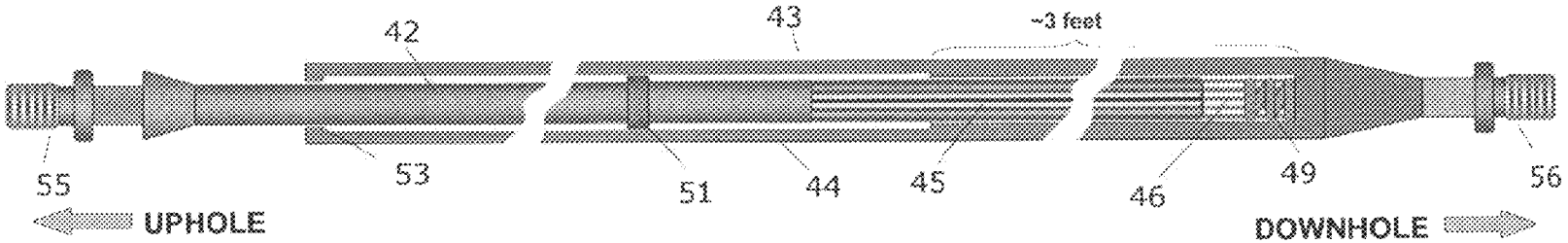
FIG. 6 is an enlarged detail of the of the captured spline assembly as shown in FIGS. 3 and 4, sectioned in order to illustrate the detail within the assembly housing.

FIG. 6 shows pictorially a side view partial cross-section of the captured spline assembly 43. Captured spine shaft 42 is shown near the bottom of its possible vertical travel within the assembly housing 44, with the male splined portion 45 engaging the female splined bore 46. Cushioning spring 49, at the downhole end of the female splined bore 46 is clearly shown. The upward vertical travel of shaft 42 within the assembly housing 44 is limited by collet 51 fixedly attached to shaft 42, collet 51 being larger in diameter than the diametric restriction 53 at the uphole end of housing 44. Both the uphole end 55 of captured spline shaft 42, and the downhole end 56 of assembly housing 44 are equipped with the threaded pin-end of a conventional drive rod coupling for tensional and torsional connection to the drive rod string 24 and the on-off assembly 47, respectively.

Figure 7A:
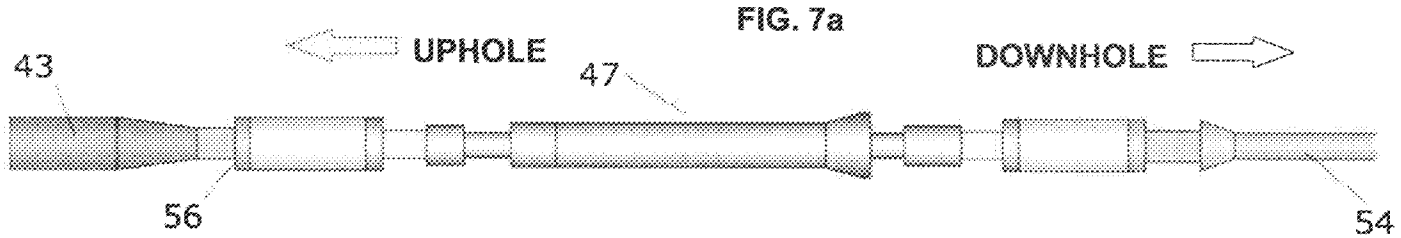
FIGS. 7*a* and *b*, are expanded views of the structure of FIGS. 3 and 4, providing detail of the on-off tool currently in use in downhole oilfield production equipment.
Figure 7B:
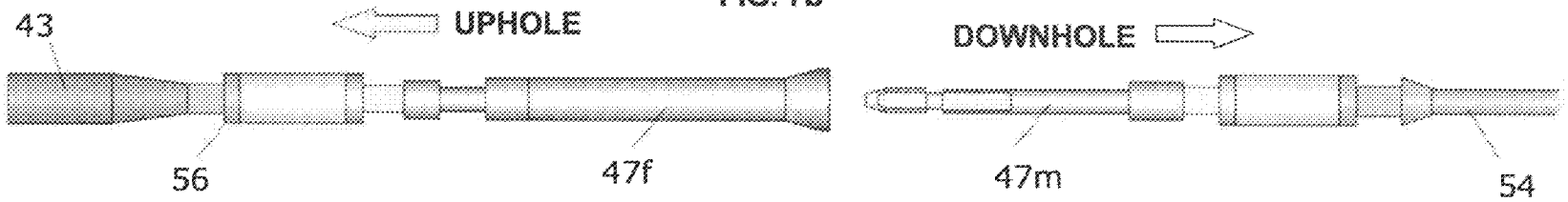

FIG. 7*a* shows a side view of the on-off tool 47, in its fully engaged state. FIG. 7*b* shows a side view of the on-off tool, with the female portion 47*f* disengaged from the male potion 47*m*.

While those skilled in the art will perceive some variation in the structural elements disclosed herein, it will be understood that the invention contemplates such variations, which are within the contemplation of the claims, I claim, as follows:

1. In a well for the capture of subterranean fluids, a system to connect a drive rod string to a downhole assembly, comprising:

a casing within said well, and a production tubing situated within said casing, said production tubing having an upper and a lower end;

a downhole assembly, said downhole assembly having an upper and a lower end, said upper end of said downhole assembly attached to said lower end of said production tubing, said downhole assembly consisting of a fluid pumping system, a drive rod string situated within said production tubing and extending from the surface to said downhole assembly located at the lower end of said production tubing, said drive rod string having an upper and a lower end;

a captured spline assembly disposed between the lower end of said drive rod string and said downhole assembly, said captured spline assembly having an upper and a lower end;

an on-off tool disposed between the lower end of said captured spline assembly and said upper end of said downhole assembly; and a rotational prime mover situated at the upper end of the production tubing, said rotational prime mover attached to said upper end of said drive rod string for the purpose of rotationally driving said drive rod string;

wherein said downhole assembly requires the input of rotational power for pumping operation, the rotational element of said rotational power consisting of an input drive shaft extending above said upper end of said downhole assembly and within said production tubing;

wherein said captured spline assembly provides a torsional and tensional connection between said drive rod string and said input drive shaft, said captured spline assembly providing limited relative vertical movement between said drive rod string and said input drive shaft while maintaining a torsional and tensional connection between said drive rod string and said input drive shaft; and wherein said on-off tool allows the connection and disconnection of said captured spline assembly from said input drive shaft, while providing a torsional and tensional connection between said captured spline assembly and said input drive shaft, said on-off tool consisting of a lower male component attached to the upper end of said input drive shaft depending upward from said downhole assembly, and an upper female component attached to said lower end of said captured spline assembly, the mating and engagement of said lower and upper components of said on-off tool providing said torsional and tensional connection between said captured spline assembly and said input drive shaft, said disconnection affected by upward tensional force on said drive rod string exceeding a pre-set tension limit of said on-off tool.

2. The system of claim 1, wherein said captured spline assembly comprises inner and outer portions, said inner and outer portions being slidably connected to provide limited relative axial movement between said portions, said relative axial movement comprising either compressional movement, wherein said inner and outer portions move toward one another, or extensional movement, wherein said inner and outer portions move away from one another.

3. The system of claim 2, wherein said extensional movement is mechanically limited, and at the limit of said extensional movement, said inner and outer portions of said captured spline assembly are in firm tensional connection.

4. The system of claim 2, wherein said compressional movement is mechanically limited, and at the limit of said compressional movement, said inner and outer portions of said captured spline assembly are in firm compressional connection.

* * * * *